US007316086B2

(12) United States Patent
Schuling et al.

(10) Patent No.: US 7,316,086 B2
(45) Date of Patent: Jan. 8, 2008

(54) OCCUPANCY SIGN FOR BATHROOM STALL

(75) Inventors: Chris Schuling, Bondurant, IA (US); Eric Schuling, Bondurant, IA (US)

(73) Assignee: Protonow Engineering, LLC, Ankeny, IA (US)

( * ) Notice: Subject to any disclaimer, the term of this patent is extended or adjusted under 35 U.S.C. 154(b) by 126 days.

(21) Appl. No.: 11/163,194

(22) Filed: Oct. 10, 2005

(65) Prior Publication Data

US 2007/0089340 A1 Apr. 26, 2007

(51) Int. Cl.
*G09F 7/00* (2006.01)

(52) U.S. Cl. ..... 40/584; 40/599; 40/606.07; 40/606.11

(58) Field of Classification Search ..... 40/584, 40/599, 606.07, 606.11, 607.1, 600, 606.01, 40/606.14, 611.01; 248/205.3, 205.4, 206.5, 248/104
See application file for complete search history.

(56) References Cited

U.S. PATENT DOCUMENTS

| | | | | | |
|---|---|---|---|---|---|
| 1,272,395 | A | | 7/1918 | Dewey | |
| 1,276,735 | A | | 8/1918 | Devney | |
| 1,706,606 | A | * | 3/1929 | Harkness | 248/300 |
| 1,807,344 | A | * | 5/1931 | Roth | 200/308 |
| 1,853,622 | A | | 4/1932 | Kennedy | |
| 2,305,426 | A | | 12/1942 | Howell | |
| 3,708,897 | A | * | 1/1973 | Adams et al. | 40/1 |
| 3,742,632 | A | * | 7/1973 | Bollbach et al. | 40/617 |
| 3,785,331 | A | * | 1/1974 | Ferris | 116/63 R |
| 4,134,222 | A | * | 1/1979 | Orsos | 40/606.15 |
| 4,167,073 | A | * | 9/1979 | Tang | 60/661.03 |
| 4,216,598 | A | | 8/1980 | Newbert | |
| 4,257,342 | A | * | 3/1981 | Ditto | 116/307 |
| 4,416,438 | A | * | 11/1983 | King | 248/102 |
| 4,422,852 | A | | 12/1983 | Mathias | |
| 4,460,119 | A | | 7/1984 | Goodfellow et al. | |
| 4,545,521 | A | | 10/1985 | Hiersteiner | |
| 4,862,617 | A | | 9/1989 | Cooke, Jr. et al. | |
| 5,253,908 | A | * | 10/1993 | Leonard, III | 292/289 |
| 5,810,404 | A | * | 9/1998 | Horne et al. | 292/288 |
| 5,906,064 | A | * | 5/1999 | Field | 40/607.11 |
| 5,911,523 | A | * | 6/1999 | Burchart | 40/406 |
| 5,996,204 | A | * | 12/1999 | Norwood | 29/450 |
| 6,546,653 | B1 | | 4/2003 | Thibodeaux, Jr. | |
| 6,588,134 | B1 | | 7/2003 | Perelli | |
| 6,612,532 | B1 | * | 9/2003 | Paulus | 248/317 |
| 6,643,964 | B1 | | 11/2003 | Stern | |
| 6,817,127 | B2 | * | 11/2004 | Gottlieb et al. | 40/661.03 |
| 6,938,861 | B1 | * | 9/2005 | Ballard et al. | 248/104 |
| 2001/0013186 | A1 | * | 8/2001 | Malitas | 40/599 |
| 2004/0068899 | A1 | * | 4/2004 | Hart | 40/124.09 |
| 2004/0074128 | A1 | | 4/2004 | Best et al. | |
| 2004/0154195 | A1 | | 8/2004 | Jewell et al. | |

* cited by examiner

*Primary Examiner*—Gary C. Hoge

(57) ABSTRACT

A sign for use with a restroom stall having a mounting plate that is detachably mounted to the inner surface of the bathroom stall. Connected to and extending from the mounting plate is a flexible or rigid cord. Connected to the opposite end of the flexible or rigid cord is a signage plate that is formed to fit between the spacing in the stall door and has a groove or notch that is formed to fit over the latch in the stall door.

7 Claims, 3 Drawing Sheets

OCCUPANCY SIGN FOR BATHROOM STALL

BACKGROUND OF THE INVENTION

This invention is directed toward a sign for indicating occupancy, and more particularly is directed toward a sign for indicating that a restroom stall is occupied.

In most public restrooms there is no sign to indicate when a bathroom stall is occupied. Thus, when a stall is in use, one might attempt to access the stall not realizing that it is presently occupied. This can create a certain amount of anxiety for the person using the stall.

While signs indicating occupancy are available for portable restrooms, to incorporate this type of signage in commercial stalls would be costly and cumbersome. In addition, such signs could not be easily adapted for use with present stall doors that do not have signage. Accordingly, there is a need in the art for a sign that addresses these problems.

Therefore an objective of the present invention is to provide an occupancy sign that is easily adaptable to existing bathroom stalls.

A further objective is to provide an occupancy sign that is easy to manufacture and install.

These and other objectives will be apparent to those skilled in the art based on the following written description.

SUMMARY OF THE INVENTION

A sign for use with a restroom stall door having a mounting plate that is detachably mounted to the inner surface of the bathroom stall. Connected to and extending from the mounting plate is a flexible or rigid cord. Connected to the opposite end of the flexible or rigid cord is a signage plate that is formed to fit between the spacing in the stall door and has a groove or notch that is formed to fit over the latch components on the stall door.

BRIEF DESCRIPTIONS OF THE DRAWINGS

DETAILED DESCRIPTION OF THE PREFERRED EMBODIMENT

Figure 1:
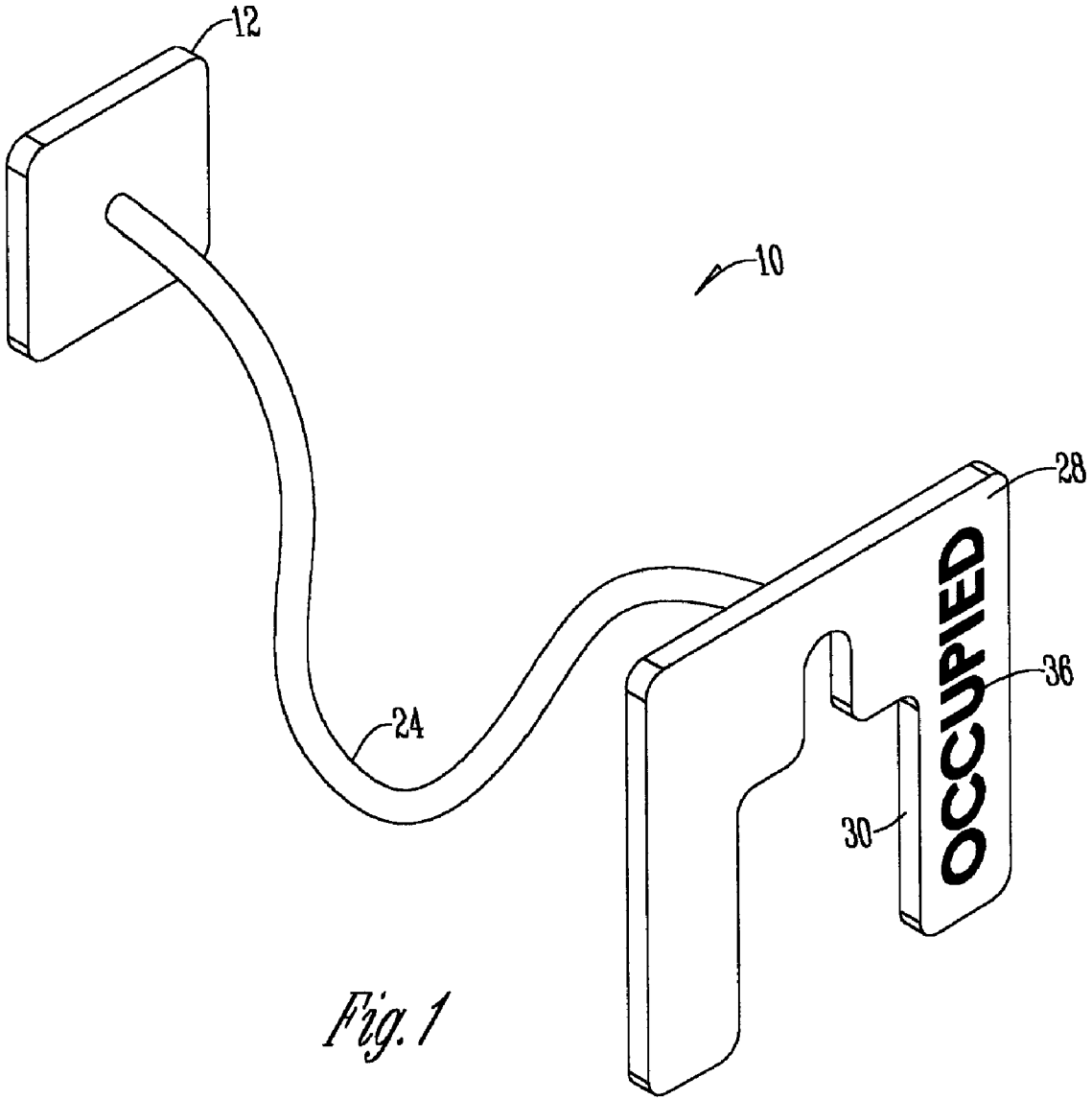
FIG. 1 is a perspective view of a occupancy sign for a stall door.
Figure 2:
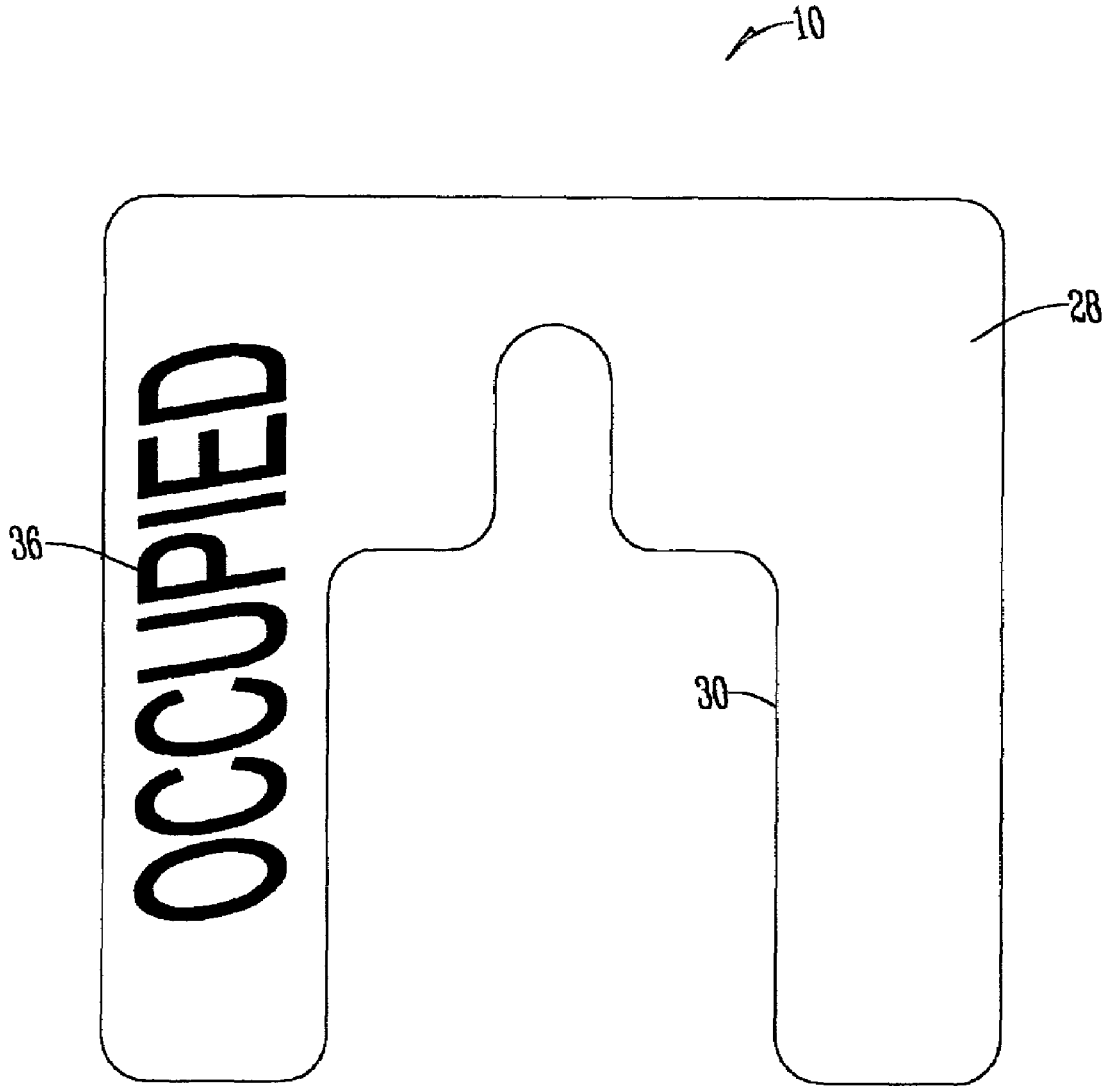
FIG. 2 is an end view of a signage plate for an occupancy sign.
Figure 3:
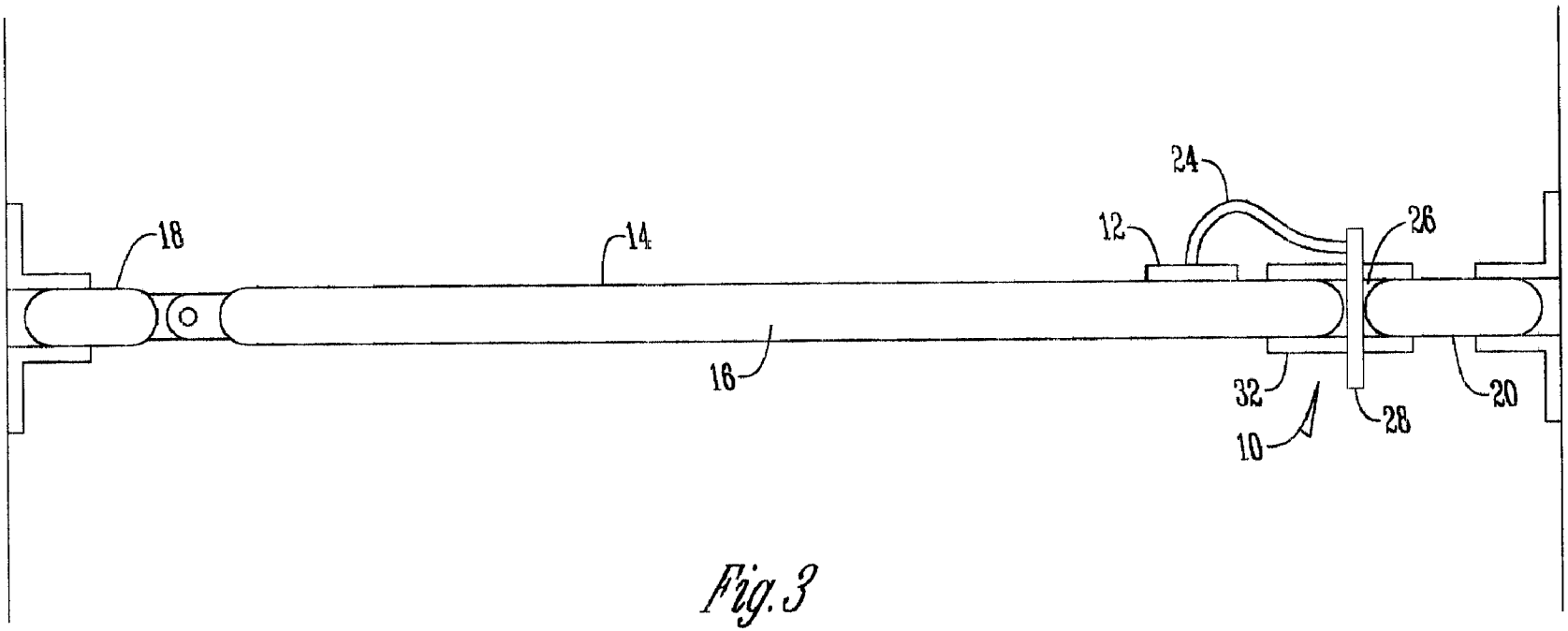
FIG. 3 is a top plan view of a stall door with an occupancy sign.

Referring to the drawings, a sign 10 has a mounting plate 12 that is detachably connected to any inner surface 14 of a bathroom stall. The bathroom stall door 16 is pivotally mounted to a support member 18 and is positioned within the same vertical plane and within spaced relation to a latching member 20. The mounting plate 12 is detachably mounted to the inner surface 14 of the stall in any conventional manner such as by bolts, glue, or the like. Connected to the mounting plate 12 at one end is a flexible or rigid cord 24. The cord 24 is of a sufficient length to extend from the mounting plate to the spacing 26 between the stall door 16 and the support member 20. Connected to the opposite end of the cord 24 is a signage plate 28. The signage plate 28 has a width that will fit between spacing 26. The signage plate 28 has a groove or notch 30 that is formed to fit over and receive the latch 32 of the stall door 16. The groove 30 can be of any shape or size.

In operation, when the stall is not occupied, the signage plate 28 hangs freely from the cord 24 that is attached to the mounting plate 12. When occupied the stall door 16 is shut and latched at which time the signage plate is inserted through spacing 26 and placed over the latch 32 such that latch 32 is received within groove 30. The signage plate 28 has indicia 36 on one or both sides that indicate that the stall is occupied.

Alternatively, the signage plate 28 is separate from the mounting plate 12 and cord 24. In this embodiment, a user may carry the signage plate 28 in a purse or pocket for selected use. Specifically, the signage plate 28 is made of a width that fits through spacing 26 such that the latch 32 is received within groove 30.

An occupancy sign that is easy to install in existing bathroom stalls that is also easy to manufacture has been shown and at least all of the stated objectives have been met.

What is claimed is:

1. An occupancy sign for a restroom stall having an inner surface and a latch, comprising:

a mounting plate adapted to be mounted to an inner surface of the stall;

a flexible cord connected to the mounting plate at one end;

a signage plate connected to an opposite end of the flexible cord, the plate having a groove adapted to receive the latch.

2. The sign of claim 1 wherein the signage plate has indicia.

3. The sign of claim 1 wherein the signage plate is of width adapted to fit between the space formed between a stall door and a support member.

4. The sign of claim 1 wherein the mounting plate is attached to an inner surface of the stall by adhesive.

5. The sign of claim 1 wherein the mounting plate is attached to an inner surface of the stall by bolts.

6. The sing of claim 1 wherein the groove has a wider portion and a narrower portion.

7. An occupancy sign for a restroom stall having a latch, comprising:

a signage plate having a groove formed therein formed to fit over and receive the latch and indicia on at least one surface of the plate; and wherein the plate is of width adapted to fit between the space formed between a stall door and a support member such that a latch is received within the groove.

* * * * *